United States Patent [19]

Hudelmaier

[11] 3,933,341

[45] Jan. 20, 1976

[54] TRANSIT CONCRETE MIXER

[76] Inventor: Gerhard Hudelmaier, Frauenstrasse 22, 7900 Ulm, Danube, Germany

[22] Filed: Jan. 29, 1975

[21] Appl. No.: 545,002

[52] U.S. Cl. ..... 259/174; 259/85

[51] Int. Cl.[2] ..... B28C 5/18

[58] Field of Search ..... 259/173, 174, 175, 176, 259/177 R, 177 A, 178 R, 169, 171, 3, 14, 15, 16, 30, 31, 32, 33, 84, 85

[56] References Cited

UNITED STATES PATENTS

| | | | |
|---|---|---|---|
| 409,560 | 7/1889 | Latham | 259/174 |
| 2,614,819 | 10/1952 | Longenecker | 259/175 |
| 2,956,790 | 10/1960 | Moriya | 259/174 |
| 3,358,973 | 12/1967 | Mitchell | 259/177 |

*Primary Examiner*—Robert W. Jenkins
*Attorney, Agent, or Firm*—James E. Nilles

[57] ABSTRACT

A transit concrete mixer has a fill and discharge opening at the apex end of a conically tapered mixing drum. The drum is mounted for rotation on its axis at an angle relative to the horizontal which places the drum on an upward slant from its bottom to the fill and discharge opening. Internal helical blading of the drum moves the concrete into and out of the drum upon its rotation in opposite directions. A rotary mixing tool is mounted in the wide end of the drum on the axis of the latter in cooperative relation to the helical blading.

10 Claims, 8 Drawing Figures

TRANSIT CONCRETE MIXER

BACKGROUND

The invention relates to concrete mixers. More particularly, the invention is concerned with a concrete mixer of the type wherein a mixing drum tapers conically toward a fill and discharge opening; wherein a stub axle is secured to the drum bottom and journaled in a bearing on a vehicle frame for rotation on an axis which slants from the drum bottom upwardly relative to the horizontal toward the fill and discharge opening; wherein the inner wall of the mixing drum is provided with helical concrete conveying elements; and wherein the mixing drum contains an auxiliary coaxial mixing tool.

A transit concrete mixer of this general type has heretofore been known in which the mixing tool consists of a helix that is mounted in a fixed position within the mixing drum. The helix extends over about two-thirds of the length of the mixing drum, and at its end next to the drum bottom it is journaled on a stub shaft which is fixed to the drum bottom and projects into the core of the helix. At its other end the helix core is extended to project outward through the fill and discharge opening of the drum where it has an angled portion which is sustained on a mounting frame for the drum. The additional mixing effect which this helix produces is small. The production costs are high due to the mounting of the helix at both ends and the spreading of its axial length over a substantial portion of the drum length. The weight of the mixer is thereby considerably increased.

Also heretofore known has been a transit concrete mixer in which a substantially cylindrical mixing drum is rotatable on a horizontal axis. In that case the mixing drum has helical blades secured to its inner wall and it is provided with a coaxial supplemental helix. The supplemental helix is supported on an overhung shaft which extends through and is rotatably mounted on the drum bottom. The other end of the shaft is journaled in a spider secured within the drum. The supplemental helix extends over the main portion of the length of the mixing drum. The drum and the helix are rotated by a drive shaft which extends parallel to the drum wall; said drive shaft, on one hand, drives a pinion in mesh with a ring gear on the drum; and on the other hand, the drive shaft is connected by a chain drive with the helix supporting shaft at the end of the latter which projects from the drum bottom. This prior art mixer has the disadvantage that the long helix increases the production costs and also considerably increases the weight of the mixer. Moreover, the spider which supports the free end of the helix supporting shaft and which faces the discharge opening of the drum from the inside, interferes with the outward movement of the concrete through the discharge opening.

SUMMARY OF THE INVENTION

The object of the present invention is to provide an improved transit concrete mixer of the hereinbefore outlined general character which will mix the concrete more thoroughly and efficiently; which may be produced at only little additional cost; which will entail no weight increase; and which will afford an unobstructed concrete discharge.

That object is achieved, according to the invention, by mounting the mixing tool on a rotary overhung driving shaft which projects into the drum from its bottom side, and by dimensioning the mixing tool so that it extends in the axial direction of the drum from the drum bottom a maximal distance of about one-half, and preferably of about one-quarter to one-third of the total length of the mixing drum.

The invention is based on the observation that in a transit concrete mixer whose mixing drum conically tapers toward the fill and discharge opening on a slanting axis which is upwardly inclined relative to the horizontal, the largely predominant portion of the concrete is contained in a portion of the mixing drum adjacent its bottom. In order to produce an additional forced intermixing effect it is therefore sufficient to operate with a mixing tool that rotates only in the bottom zone of the mixing drum. Such a forced intermixing tool may be mounted on an overhung shaft. That makes it unnecessary to extend the shaft through the entire length of the mixing drum and/or to provide another support for the shaft within the mixing drum. The design therefore becomes simple, light and inexpensive. The concrete conveying elements which are secured to the inside wall of the drum and which conventionally have the shape of helically extended blades may have a larger pitch than heretofore and may perform only a conveying function since the mixing is exclusively reserved for the mixing tool. In transit, the drum may therefore be rotated at a smaller number of revolutions per minute. This results in a prolonged life of the parts which are subject to wear.

Preferably, the mixing tool comprises a circular series of arms projecting radially from the shaft and having at their free ends blades which extend close to the inner edges of concrete conveying elements in the drum. This produces an excellent force intermixing effect with simple means. However, it is of course also possible within the scope of the invention to use other mixing tools, preferably force intermixing tools, with discontinuous flow and feed toward the center of gravity.

In the preferred embodiment of the invention the drum supporting stub axle is hollow and the shaft which mounts the mixing tool is extended through the hollow stub axle and may be rotatably supported therein. In this manner a simple, space saving and reliable mounting of the mixing tool supporting shaft will be obtained.

Preferably, the mixing tool supporting shaft is driven by means of speed reducing gearing by a motor on the vehicle frame.

In this connection, it is particularly advantageous if the speed reducing gearing is sustained on the vehicle by means of a movable torque brace and is at least partially supported on the stub axle or shaft; and if flexible power transmitting means, particularly hydraulic conduits extend between a pump on the vehicle frame and a fluid motor associated with the speed reducing gearing. In this manner all effects of vehicle frame distortion upon the speed reducing gearing are eliminated so that the gearing will operate with little wear.

A particularly simple drive will be obtained if the drum is provided with a driving ring gear at its bottom; if the mixing tool supporting shaft is provided with a gear wheel inside the ring gear; and if an intermediate gear wheel is rotatably mounted on a support so as to mesh with the shaft gear wheel and with the ring gear. In this case one drive suffices because the transmission which turns the mixing drum by means of the ring gear simultaneously turns the mixing tool by means of the intermediate gear.

In the last mentioned case a double armed rocker element is preferably journaled on the shaft and stabilized relative to the vehicle frame by a movable torque brace. One arm of the rocker element forms the support for the intermediate gear, and the other arm mounts a conventional speed reducing gear assembly which cooperates with the ring gear to drive the mixing drum. The entire drive mechanism and support arrangement thereby become space saving, and easy to manufacture and install.

It is also possible, however, to pivot on the stub axle a support which is stabilized relative to the vehicle frame by a movable torque brace, and to mount two speed reducing gear assemblies on said support, one of which drives the mixing tool supporting shaft and the other of which drives the hollow stub shaft which is rigidly secured to the mixing drum. In this manner it is possible to provide an independent speed reducing gear drive for the mixing drum and another for the mixing tool.

DRAWINGS

The foregoing and other objects and advantages will become more fully apparent as this specification proceeds with reference to the accompanying drawings wherein.

DETAILED DESCRIPTION

Figure 1:
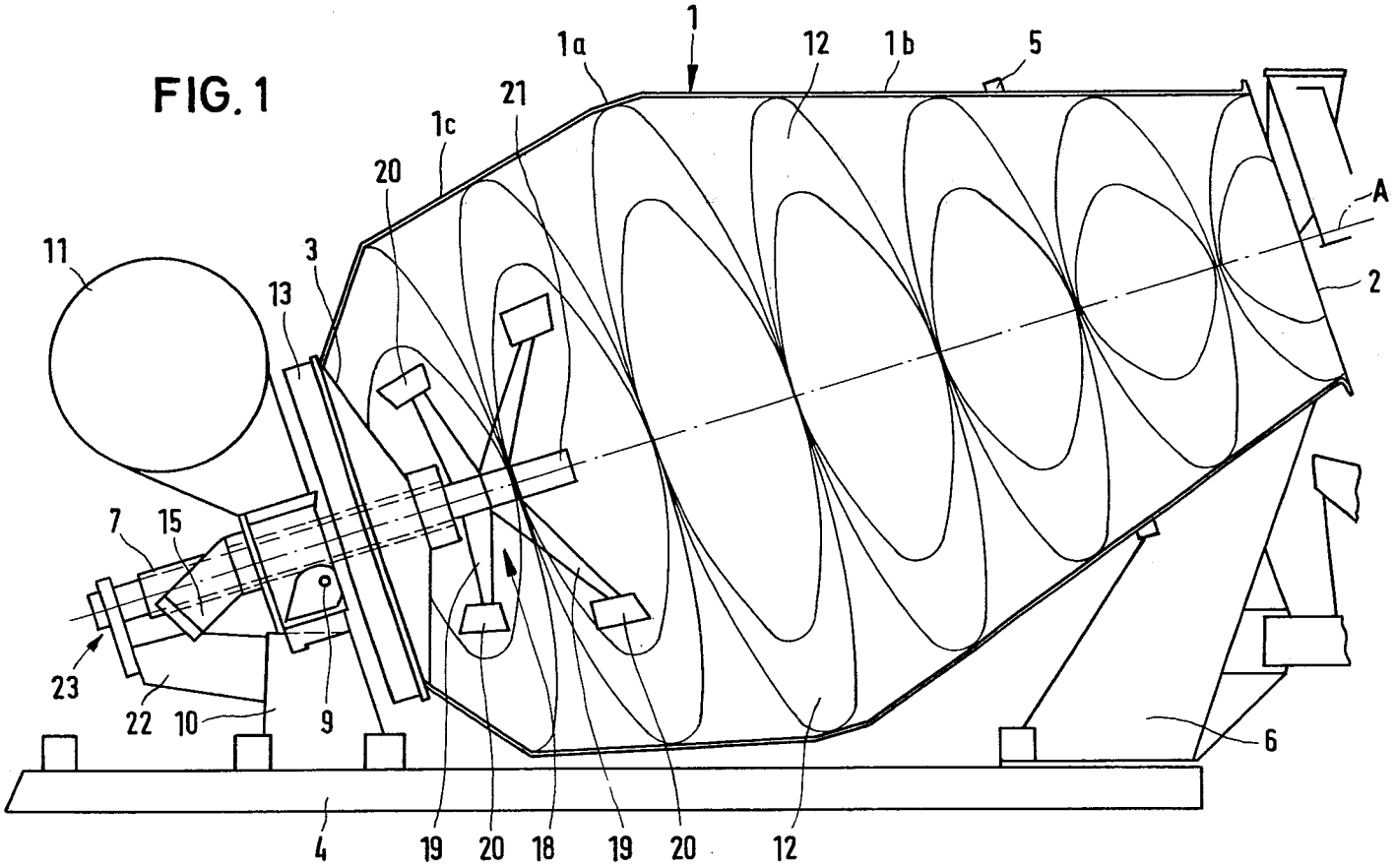
FIG. 1 is a schematic side view, partly in section, of a mixing drum incorporating a first embodiment of the invention in a transit concrete mixer.
Figure 2:
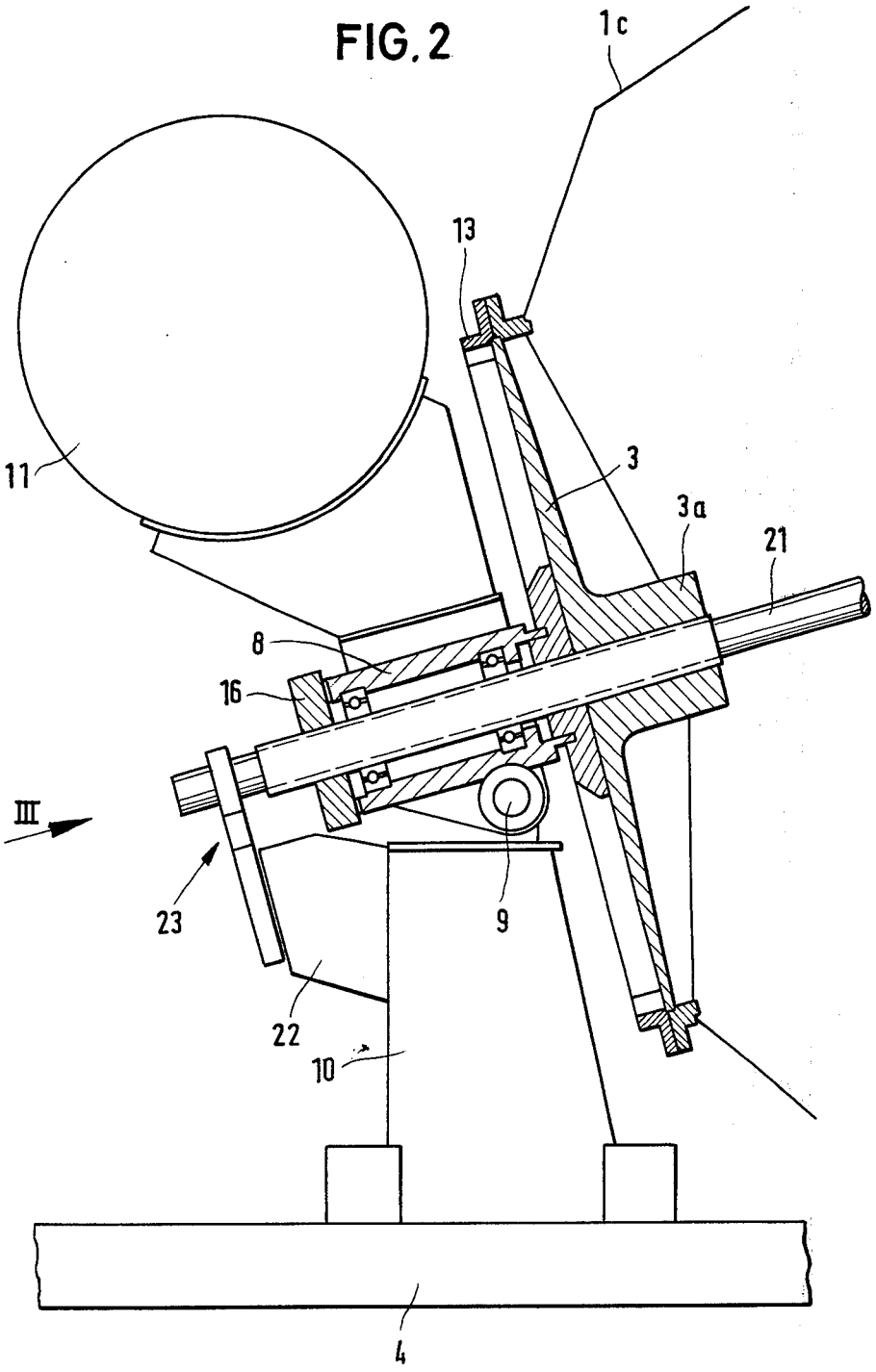
FIG. 2 is a sectional view of the drum bottom zone of the mixing drum according to FIG. 1.
Figure 3:
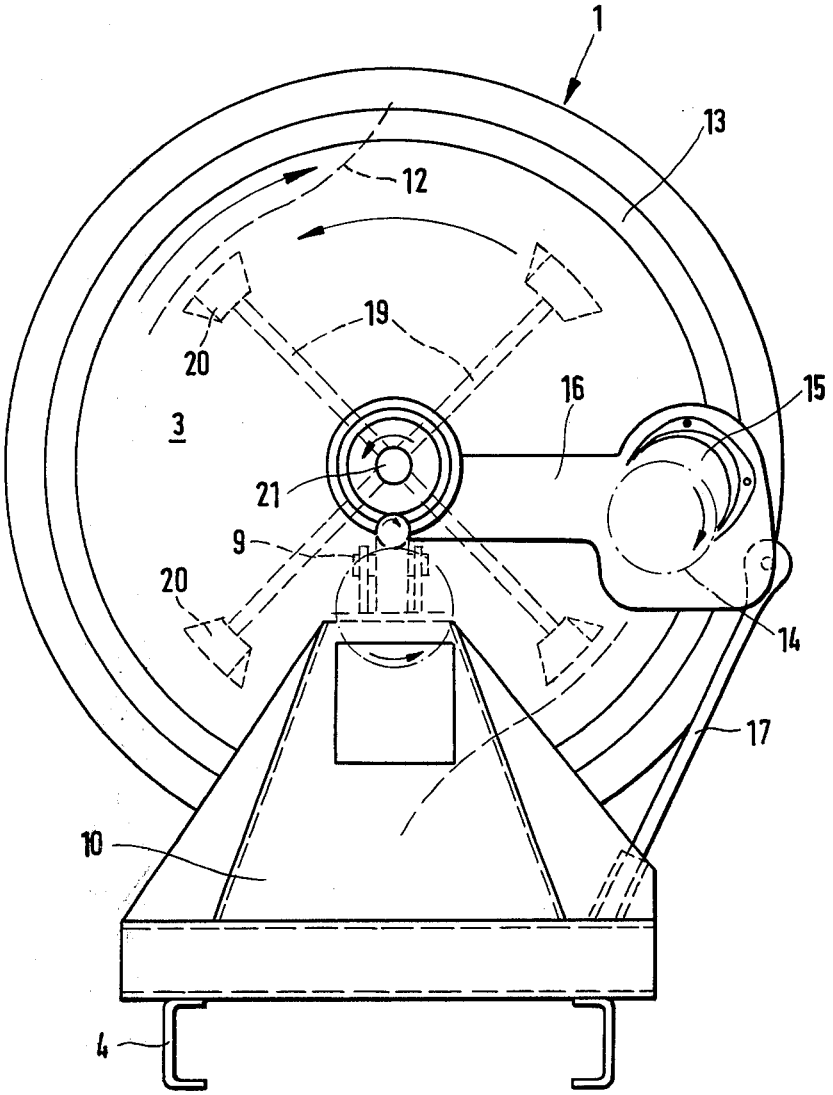
FIG. 3 is an elevational view of the drum bottom, taken in the direction of arrow III in FIG. 2.

In FIGS. 1–3 the reference numeral 1 designates a mixing drum which conically tapers in opposite directions from the zone 1*a* of maximum diameter. The rearwardly tapering section is designated by the reference numeral 1*b* and terminates in the customary fill and discharge opening 2. The forwardly extending section is designated by the reference numeral 1*c* and terminates in a drum bottom 3. The mixing drum 1 is supported on a frame 4 which may be the chassis frame of a motor truck, not shown, or an intermediate frame mounted on the chassis frame. The mixing drum 1 has an axis A which slants upward relative to the frame 4. It is rotatably supported by means of a circular rail 5 which surrounds the drum section 1*b* and rests on a pedestal 6, and by means of a hollow stub shaft 7 which is connected to a hub 3*a* of the drum bottom 3. The stub shaft 7 is journaled in a mounting barrel 8 which in turn is connected to a pedestal 10 on the frame 4 by means of a hinge 9 which facilitates mounting of the drum in its operative position and which is locked upon completion of the assembly.

The mounting barrel 8 supports a conventional water tank 11.

The inner wall of the drum is provided with helical blades 12 of relatively large pitch whereby concrete fed into the drum through the opening 2 is drawn toward the drum bottom 3 upon rotation of the drum in one direction, and whereby the concrete is discharged through the opening 2 upon rotation of the drum in the other direction. The blades 12 are laid out so as to be specifically adapted for conveying concrete.

For transmitting driving torque to the drum a ring gear 13 is secured thereto exteriorly of the drum bottom 3. The ring gear 13 meshes with a pinion 14 (FIG. 3) of a fluid motor indicated at 15. The fluid motor 15 is mounted on a rocker arm 16 which is pivoted at its inner end on the stub shaft 7. At its outer end the rocker arm 16 is stabilized relative to the frame 4 by means of a movable torque brace 17.

The fluid motor 15 is driven via hydraulic conduit lines by a pump, not shown, which is mounted on the frame 4 and driven by the internal combustion engine of the vehicle as by a separate motor.

Provided within the mixing drum 1 is a mixing tool generally designated by the reference numeral 18. The mixing tool comprises two circular series of arms 19 which are provided at their free ends with blades 20. The mixing tool 18 is supported by an overhung shaft 21 which projects freely into the interior of the mixing drum 1 and is journaled in the hollow stub axle 7. The shaft 21 is driven independently of the mixing drum by a motor 22, for instance a fluid motor, via a speed reducing gearing 23. The mixing tool is so dimensioned that it extends in the axial direction of the mixing drum from the drum bottom over a range of about one-fourth of the length of the mixing drum. It could also cover a somewhat greater range, up to a maximum of about one-half of the length of the mixing drum but the optimal length range is about one-fourth up to one-third of the drum length. As may be seen particularly from FIG. 3 the mixing tool 18 rotates in a direction opposite to the direction of rotation of the mixing drum 1; and the blades 20 are so arranged that during rotation they barely clear the inner edges of the helical blades 12. In this manner positive mixing of the concrete within the mixing drum during transit is achieved. In practice, the mixing drum may rotate very slowly or may temporarily even not rotate at all.

Figure 4:
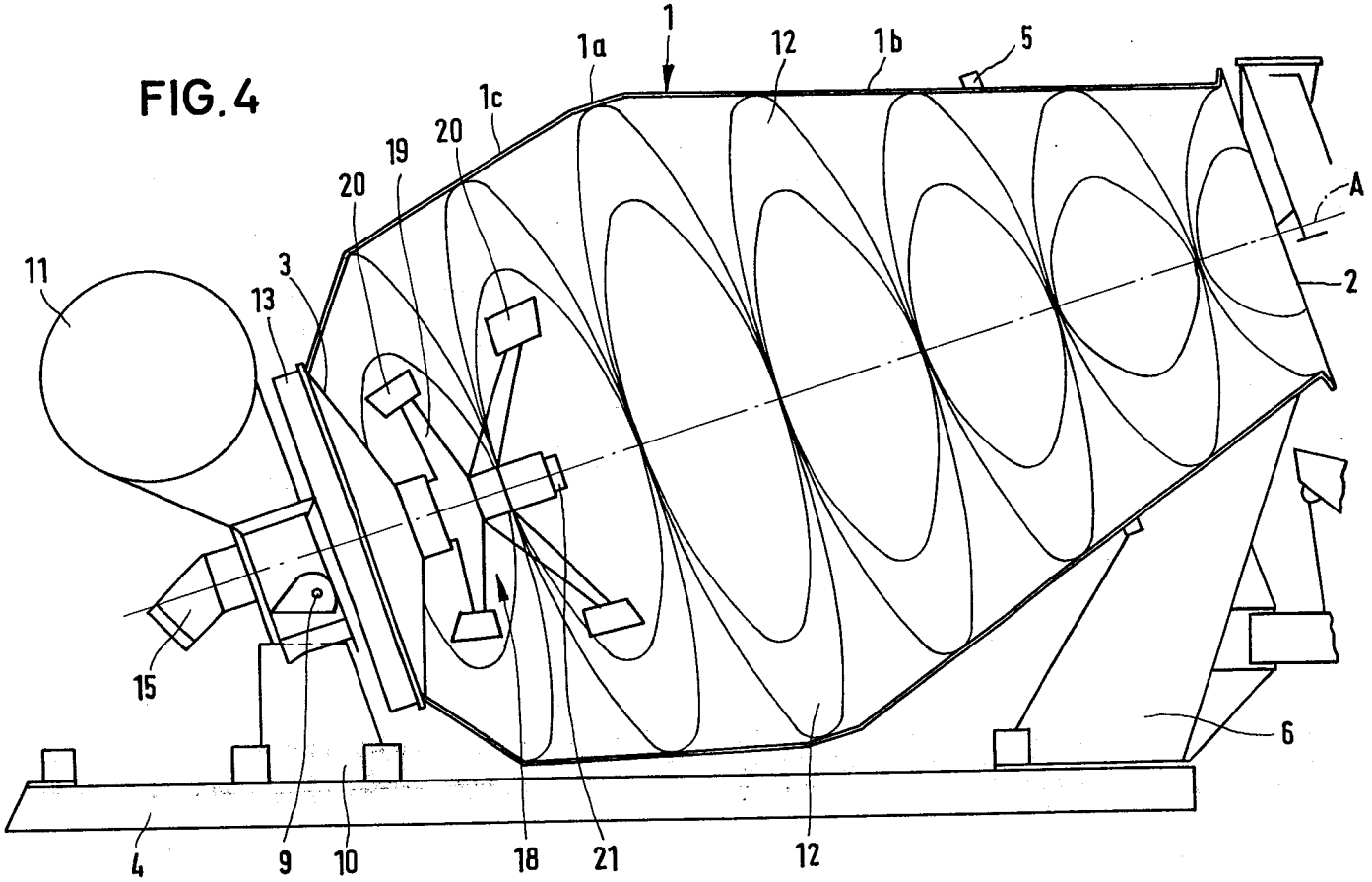
FIG. 4 is a schematic side view, partly in section, of a mixing drum incorporating a second embodiment of the invention in a transit concrete mixer.
Figure 5:
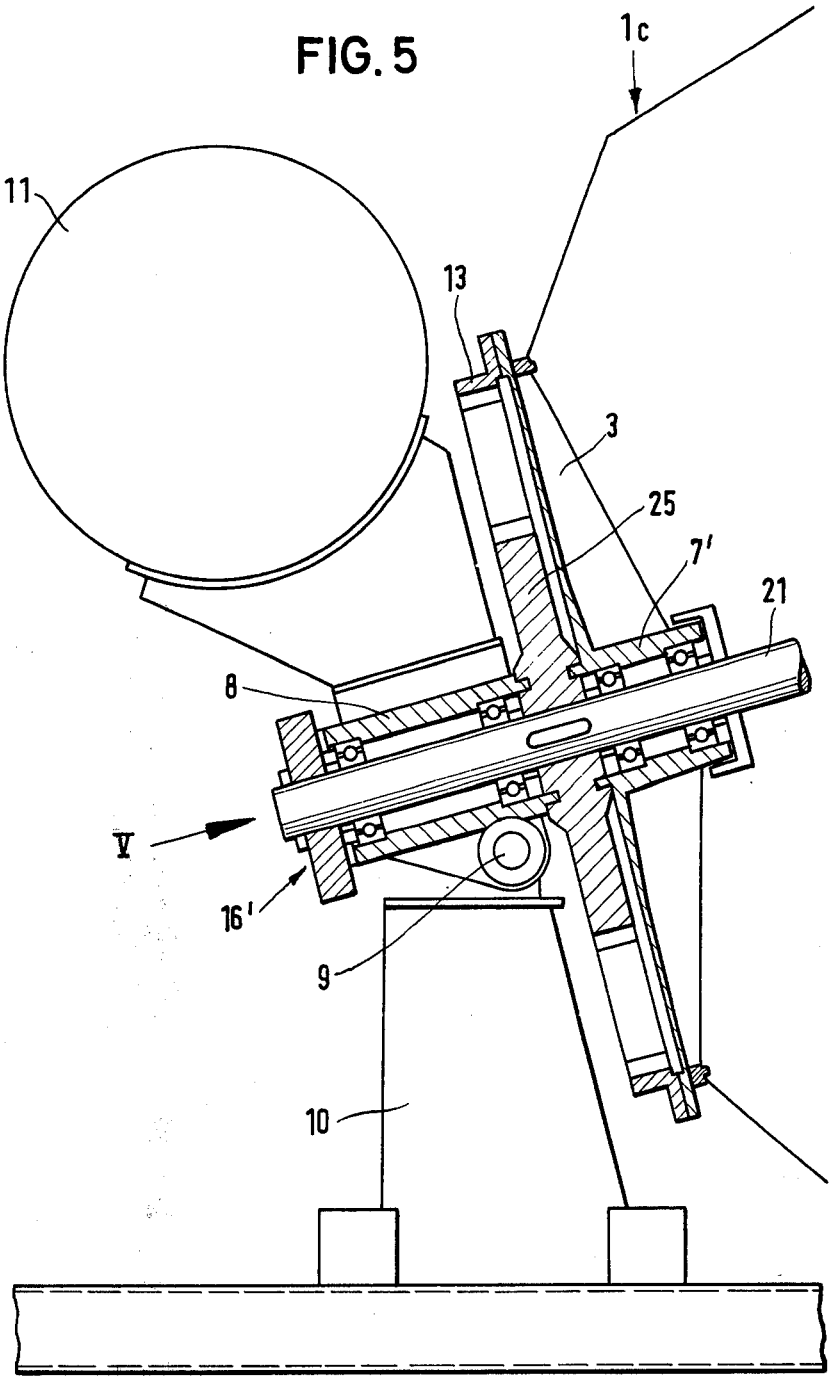
FIG. 5 is a sectional view of the bottom zone of the mixing drum according to FIG. 4.
Figure 6:
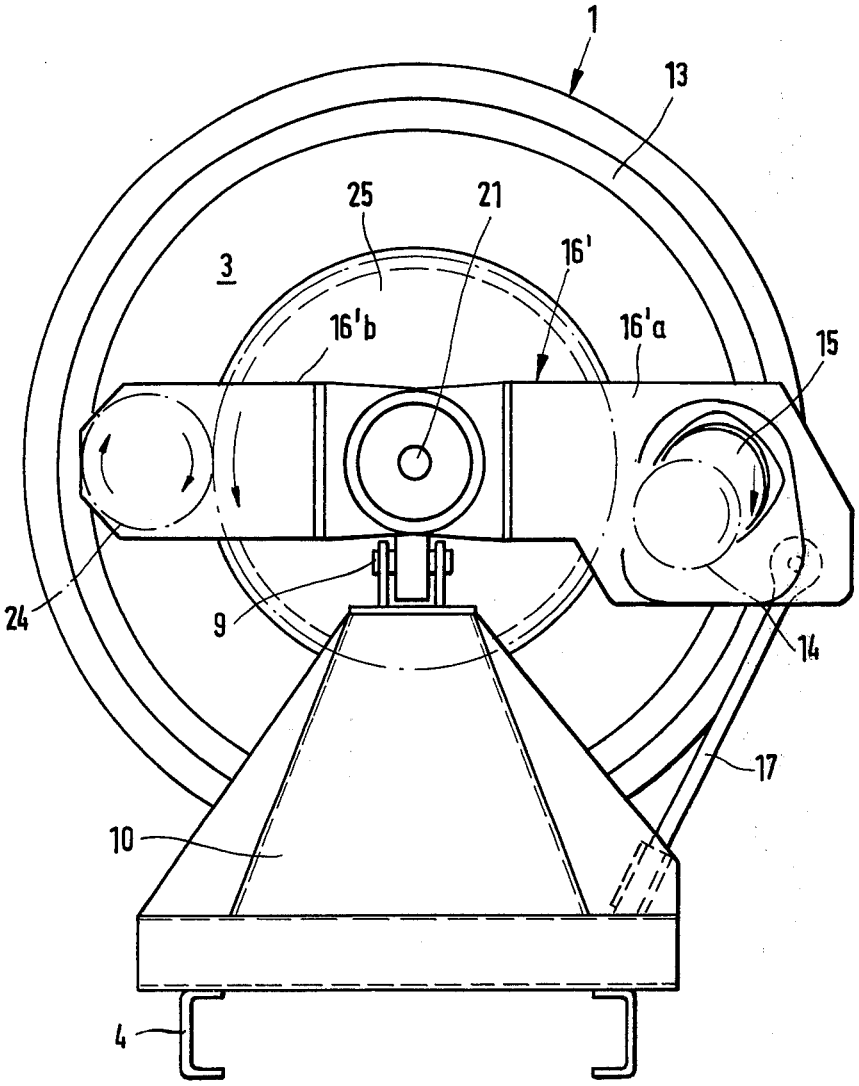
FIG. 6 is an elevational view of the bottom zone of the mixing drum according to FIG. 5, taken in the direction of arrow V.

Insofar as the embodiment according to FIGS. 4 to 6 conforms with the embodiment according to FIGS. 1 to 3, corresponding parts are designated by the same reference numerals, and they will not be described again hereinbelow. The mixing tool supporting shaft 21 is here directly journaled in the bearing barrel 8 and secured against axial displacement. The drum supporting hollow stub shaft 7' extends hub-like into the interior of the mixing drum and is journaled on the shaft 21. In this case the shaft 21 therefore forms the connection between the hub-like stub shaft 7' and the bearing barrel 8.

A double armed rocker element 16' is journaled on the shaft 21 and secured against axial displacement thereon. Like the rocker arm 16 of the embodiment according to FIGS. 1 to 3, one arm 16'*a* of the rocker element 16' mounts the fluid motor 15 whose associated pinion 14 meshes with the ring gear 13. The rocker 16', however, has another arm 16'b which extends radially outward from the shaft 21 at the side of the latter opposite to the arm 16'*a;* and journaled on the arm 16'*b* is an intermediate gear 24 which meshes with the ring gear 13 on one hand, and on the other hand with a gear wheel 25 which is keyed to the shaft 21 inside the ring gear 13.

In this embodiment the shaft 21 with the mixing tool 18 is turned by the same drive which turns the drum 1. The rotation of the ring gear 13 by operation of the fluid motor 15 and its associated pinion 14 is transmitted by the intermediate gear 24 to the gear wheel 25 and by the latter to the shaft 21 with the mixing tool 18. As a result, and due to the use of the shaft 21 as a supporting element for the drum 1, a particularly simple, space saving assembly outside of the drum bottom 3 is achieved.

Figure 7:
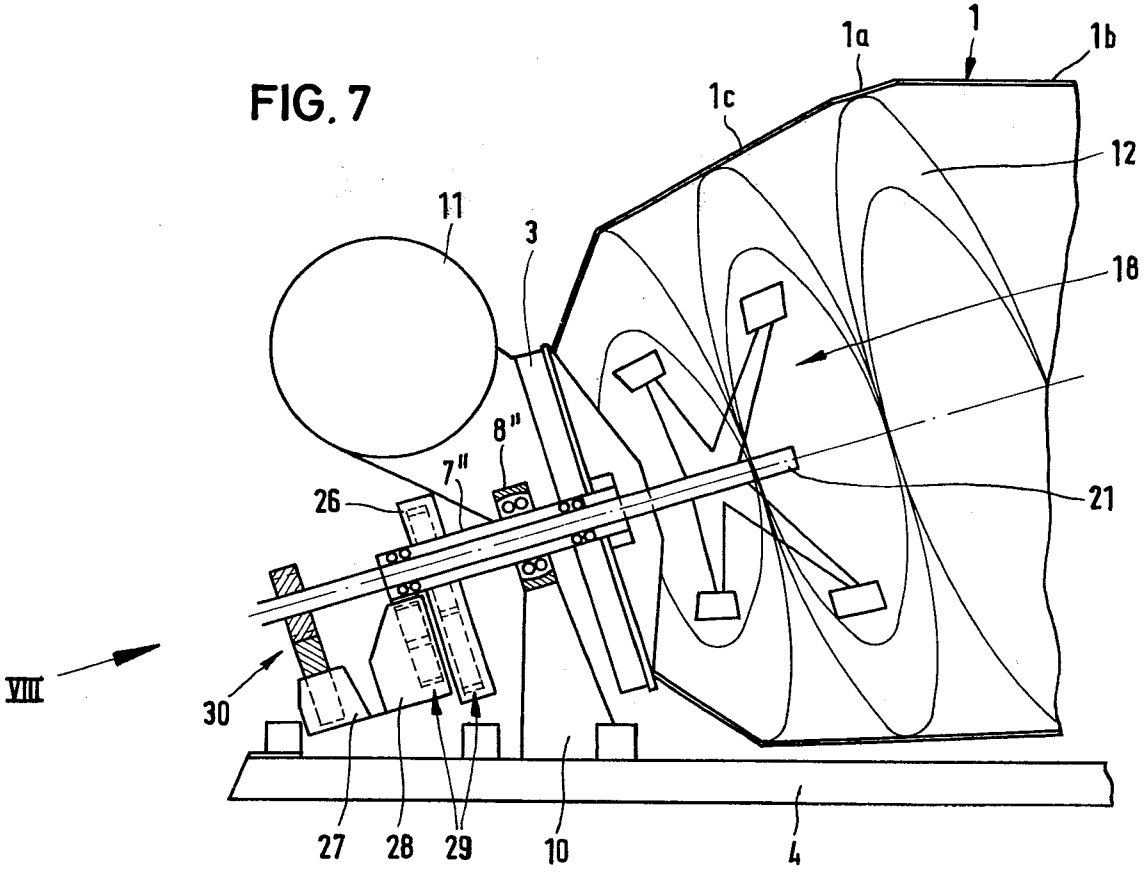
FIG. 7 is a schematic partial section of a mixing drum incorporating a third embodiment of the invention in a transit concrete mixer.
Figure 8:
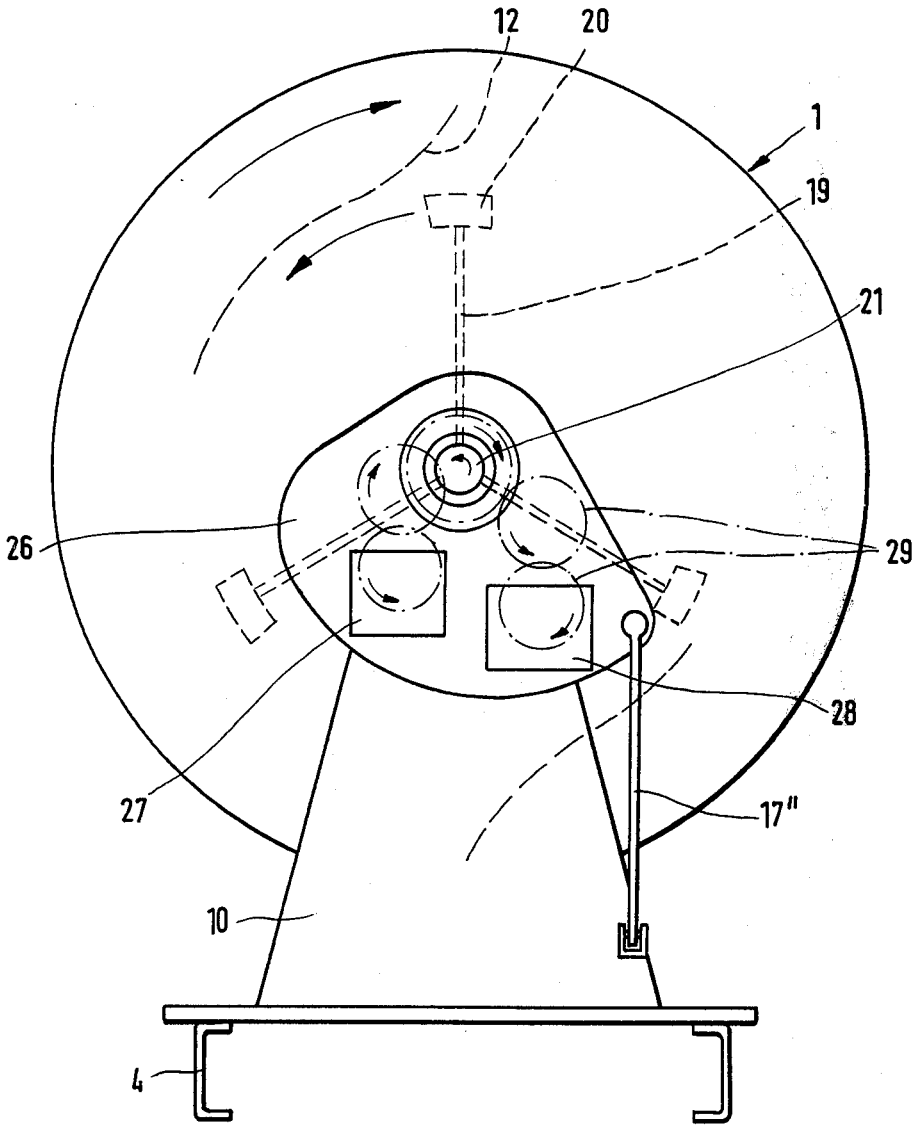
FIG. 8 is an elevational view in the direction of arrow VIII in FIG. 7, showing the drum bottom zone on a larger scale than FIG. 7.

In the embodiment according to FIGS. 7 and 8 parts which are identical with corresponding parts of the embodiment according to FIGS. 1 to 3 or according to FIGS. 4 to 6 are again designated by the same reference numeral and will not be redescribed hereinbelow.

The stub axle 7'' which is rigidly connected with drum bottom 3 engages and extends beyond the supporting bearing 8'' which is mounted pendulum fashion on the pedestal 10. The shaft 21 which carries the mixing tool 18 extends through and outward beyond the hollow stub axle 7''. A housinglike support member 26 is journaled on the stub axle 7'' and carries two fluid motors 27 and 28. Hydraulic conduit lines, not shown, connect the motors 27 and 28 with a motor driven pump, not shown, which is mounted on the vehicle frame 4. The fluid motor 28 drives the stub axle 7'' and therefore the drum 1 by means of a speed reducing gearing 29. The fluid motor 27 drives the mixing tool supporting shaft 21 by means of another speed reducing gearing 30 (FIG. 7). The housinglike support member 26 is stabilized relative to the vehicle frame 4 by means of a movable torque brace 17''.

The two last mentioned embodiments have the advantage that distortions of the vehicle frame do not in any way affect the speed reducing gearings.

The invention is not limited to the embodiments shown by way of example. The number of circular scoop assemblies which form the mixing tool 18 is optional. Instead of circular scoop assemblies other mixing tools may be used, for instance a helical mixing element, preferably with interrupted helix flights. The drive of the speed reducing gearings of the two last mentioned embodiments could be effected by flexible shafting driven by a motor on the vehicle frame rather than by pumps and fluid motors. In the embodiment according to FIGS. 4 to 6 the drum could be provided with an outwardly projecting stub axle which is journaled in the bearing barrel 8 and which in turn supports the rocker 16'.

I claim:

1. A transit concrete mixer wherein a mixing drum tapers conically toward a fill and discharge opening and is mounted on a vehicle frame for rotation on an axis which extends in the direction from the drum bottom toward said opening on an upward slant relative to the horizontal by means of a stub axle secured to said drum bottom and projecting therefrom into a supporting bearing; wherein said drum is provided at its inner wall surface with axial concrete conveying elements and encloses a coaxial supplemental mixing tool which extends in the direction of the drum axis from said drum bottom over a range of not more than about one-half of the total drum length, said mixing tool being mounted on an overhung shaft associated with said drum bottom; and wherein drive means exteriorly of said drum are operatively connected to said mixing drum and to said overhung shaft.

2. A transit concrete mixer as set forth by claim 1 wherein said mixing tool comprises a circular series of arms which extend radially from said overhung shaft, and blades at the free ends of said arms which project closely to the inner edges of said concrete conveying elements.

3. A transit concrete mixer as set forth by claim 1 wherein said mixing tool comprises two coaxial groups of said arms and blades thereon, one behind the other.

4. A transit concrete mixer as set forth by claim 1 wherein said stub axle is hollow and said mixing tool mounting shaft extends through said stub axle.

5. A transit concrete mixer as set forth by claim 4, wherein said mixing tool mounting shaft is journaled within said stub axle.

6. A transit concrete mixer as set forth by claim 1, and further comprising a motor on said vehicle frame and a speed reducing gearing operatively connecting said motor with said mixing tool mounting shaft.

7. A transit concrete mixer as set forth by claim 6, wherein said speed reducing gearing is mounted for pivotal movement about the axis of said stub shaft; wherein a torque brace is operatively interposed between said speed reducing gearing and said vehicle frame; wherein a pump on said vehicle frame is driven by said motor; wherein a fluid motor is drivingly connected with said speed reducing gearing; and wherein flexible conduit lines connect said pump with said fluid motor.

8. A transit concrete mixer as set forth by claim 1 wherein said drive means comprise a ring gear secured to said drum bottom, a gear wheel secured to said shaft interiorly of said ring gear, and an intermediate gear in mesh with said ring gear and gear wheel.

9. A transit concrete mixer as set forth by claim 8 and further comprising a double armed rocker element which is pivoted on said shaft, and a torque brace operatively interposed between said rocker element and said vehicle frame, said intermediate gear being mounted on one arm of said rocker element, and a speed reducing gearing being mounted on the other arm of said rocker element including a pinion in mesh with said ring gear.

10. A transit concrete mixer as set forth by claim 1, and further comprising a support which is pivoted on said stub axle, and a torque brace operatively interposed between said support and said vehicle frame; and wherein said drive means include two speed reducing gearings one of which drives said mixing tool mounting shaft, and the other of said speed reducing gearings driving said stub shaft.

* * * * *